United States Patent [19]

Hildreth et al.

[11] 4,081,782

[45] Mar. 28, 1978

[54] COMBINED ROTARY POTENTIOMETER AND SWITCH

[75] Inventors: Bradrick Alan Hildreth, Covina; Donald Harrison Stephens, Running Springs; George Richard Wiley, Ontario, all of Calif.

[73] Assignee: Bourns, Inc., Riverside, Calif.

[21] Appl. No.: 711,345

[22] Filed: Aug. 4, 1976

[51] Int. Cl.[2] ..... H01C 10/50

[52] U.S. Cl. ..... 338/200; 338/164; 338/184; 338/172; 338/198; 338/199

[58] Field of Search ..... 338/162, 164, 171, 172, 338/191, 198, 200, 201, 188, 184, 199

[56] References Cited

U.S. PATENT DOCUMENTS 2,451,241 10/1948 Rosentreter ..... 338/198 X

*Primary Examiner*—C. L. Albritton

*Attorney, Agent, or Firm*—Paul H. Ware; William G. Becker

[57] ABSTRACT

A potentiometer and switch combination including a rotatable control cap positioned over a potentiometer body to form a housing. The cap is provided with an annular flange which abuts an annular shoulder on the body, either the flange or the shoulder being formed from stiffly flexible, resilient material. The body holds the cap in place by means of a post having a chevron at its upper end which mates with a recess in the cap. The cap is positioned to deform the stiffly flexible, resilient material into frictional sealing relation with its abutting member and thereby seal the interior of the housing. The sealing arrangement also introduces a torque which opposes rotation of the cap. The switch includes a conductive strip held by the body, one portion of the strip forming a first contact and another portion forming a spring detent. A cantilever spring blade which holds a second contact adjacent to and radially inward from the first contact urges the contacts together, while a non-conductive blocking member projects downwardly from the cap to separate the contacts when the switch is off. Rotating the cap moves the blocking member out from between the contacts, permitting them to close, and also causes the spring detent to snap against the blocking member and give the operator a positive switch feel.

The device is particularly suited for use in a hearing aid.

18 Claims, 8 Drawing Figures

COMBINED ROTARY POTENTIOMETER AND SWITCH

BACKGROUND OF THE INVENTION

The present invention relates to combined potentiometer and switch units, and more particularly to such devices of the single-turn rotary type which are adaptable for use with a hearing aid.

Various hearing aid designs are presently available. For example, they may be encapsulated into an ear mold and inserted into or behind the wearer's ear, or mounted on a pair of eyeglasses. In either case, it is desirable that the hearing aid be as small as possible so as to minimize its weight and visibility. It is also important that the hearing aid control be adequately sealed. In addition to the normal atmospheric substances such as dust and moisture, the control must operate in an environment which includes perspiration, body oils, and the like. Adequate sealing is made difficult, however, due to the requirement that the control be manually adjustable and accordingly have a control knob or cap of appreciable size.

In addition to the potentiometer or variable resistance device for volume control, many hearing aid controls incorporate a switch to turn the device off when it is not in use and thus save wear on the battery. It is desirable that the switch have a snap feel when it is actuated so the user knows when the switch has been turned on or off. This snap feel should not, however, interfere with normal operation of the volume adjustment portion of the device, which should have a smooth rotational friction that gives the user a steady, positive feel as the volume is adjusted. In addition, it is of course always advantageous to reduce the complexity and cost of control devices, and to this end any parts that can be eliminated without impairing operation of the control is desirable.

In U.S. Pat. No. 3,518,604 to Beaver and Van Benthuysen an improved potentiometer sealing device is described. The potentiometer, which is not described as being intended for use with a hearing aid, includes a housing with an aperture through which a control driver is mounted. The driver comprises a body portion inside the housing and a cylindrical portion or barrel extending from the body portion outwardly through the aperture. The body portion is held firmly against the inner housing wall while the opposite end of the barrel is flared outwardly over the external edge of the aperture to form a flared bearing and dust-excluding seal around the periphery of the aperture. Although the patent notes the attainment of an adequate dust seal with the above construction, a preferred embodiment utilizes a lip, in the form of a flap around the periphery of the aperture, which is contacted by the barrel to improve the seal. A relieved area may underlie the flap so that a sufficient pressure of engagement between the flap and the flared bearing depresses the flap into the relieved area. While the described potentiometer may provide adequate sealing and torque control, further improvement is possible in terms of the complexity of both the component parts and the assembly procedure.

SUMMARY OF THE INVENTION

In view of the above problems and requirements associated with the prior art, a principal object of the present invention is the provision of a novel and improved potentiometer having a simplified construction with facilities for a switch.

Another object is the provision of a potentiometer having a housing with an improved seal.

Another object is the provision of a potentiometer with an improved rotational torque control mechanism for an operating knob.

Still another object is the provision of a potentiometer having a novel and improved wiper spring construction.

An additional object is the provision of a potentiometer and switch combination having an improved switching mechanism.

Another important object is the provision of a combined potentiometer and switch suitable for use with a hearing aid.

In the accomplishment of these and other objects of the invention, a rotary potentiometer is provided with a body portion having an annular shoulder around its periphery, a resistance element and collector means secured to the body portion, termination means associated with the resistance element and collector means, a control cap rotatably positioned over the body portion and forming therewith a housing for the resistance element and collector means, means securing the cap to the body portion, and an electrically conductive wiper means controlled by rotation of the cap for electrically and mechanically coupling the resistance element to the collector means. An annular flange on the cap abuts the shoulder of the body portion, either one or both of the shoulder and flange being formed from a stiffly flexible, resilient material. The cap and body portion are held together with sufficient pressure to deform the stiffly flexible, resilient material and provide a frictional seal between the shoulder and flange. The interior of the housing is thereby effectively sealed and a desirable torque opposing rotation of the cap introduced.

An improved switch incorporated into the potentiometer includes a first contact held in a cavity in the housing and spaced from the center thereof, a second contact, a cantilever spring holding the second contact adjacent to and radially inward from the first contact and urging the two contacts together, a nonconductive blocking member projecting downwardly from the cap between the two contacts, and terminals associated with each of the contacts. Rotating the cap moves the blocking member out from between the contacts, permitting them to close. The blocking member is returned to a position separating the contacts when the cap is rotated back to its initial position.

In a preferred embodiment the shoulder comprises a stiffly flexible, resilient lip extending outwardly from the body portion. The flange includes an inner annular wall which is disposed at an angle to horizontal greater than that of the upper lip surface. The cap is press-fit over the body portion to flex the lip downwardly and establish a frictional surface contact between the inner flange wall and upper lip surface. A boss formed from a stiffly flexible, resilient material extends downwardly from the cap and is provided at its underside with an axial recess. Extending axially upward from the body portion is a post having a chevron at its upper end which is seated in the recess. The chevron deforms the adjacent boss material to prevent the body portion and cap from separating. A wiper spring for electrically and mechanically bridging the resistance element and collector is fastened in place by means of a barbed tab which fits into a slot on the underside of the boss. An additional feature involves a spring detent, formed on a conductive strip which also includes the first switch contact, which is positioned in the rotational path of the blocking member to be snapped when the contacts are switched, thereby giving the user a positive feel.

DESCRIPTION OF THE DRAWINGS

Further advantages and features of the invention will be apparent to those skilled in the art from the ensuing detailed description thereof, taken together with the accompanying drawings, in which.

DESCRIPTION OF A PREFERRED EMBODIMENT

Figure 1:
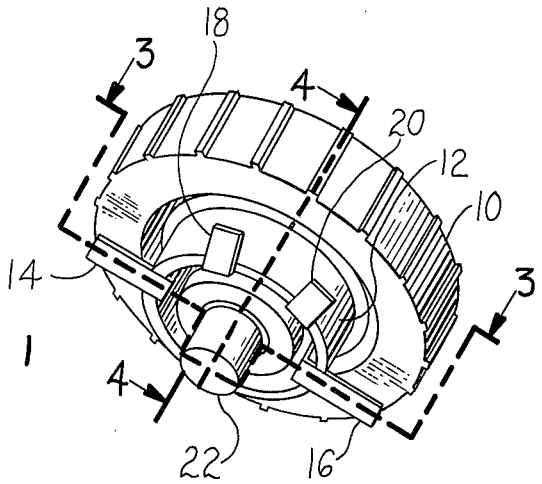
FIG. 1 is a perspective view of a potentiometer and switch combination embodying the invention.

A combined potentiometer and switch utilizing the features of the present invention is shown fully assembled in FIG. 1. A cap 10, which functions as a control knob, is seated over a hollow body portion 12 and forms therewith a sealed housing having an interior chamber for the internal elements of the device. A pair of terminals 14, 16 are provided for external connection to the switch, while terminals 18, 20 and center pin 22 connect respectively to opposite ends and the collector of a potentiometer mechanism. Center pin 22 could also be provided as a terminal similar to terminals 18, 20 if desired, but it has been found convenient to have it in the form shown and to manufacture body 12 by molding it around pin 22. Although the potentiometer shown and described herein is of the three-terminal type with two fixed end terminals and a movable intermediate contact, the term "potentiometer" is also intended to include simple variable resistors with a single fixed terminal and a movable contact.

Figure 2:
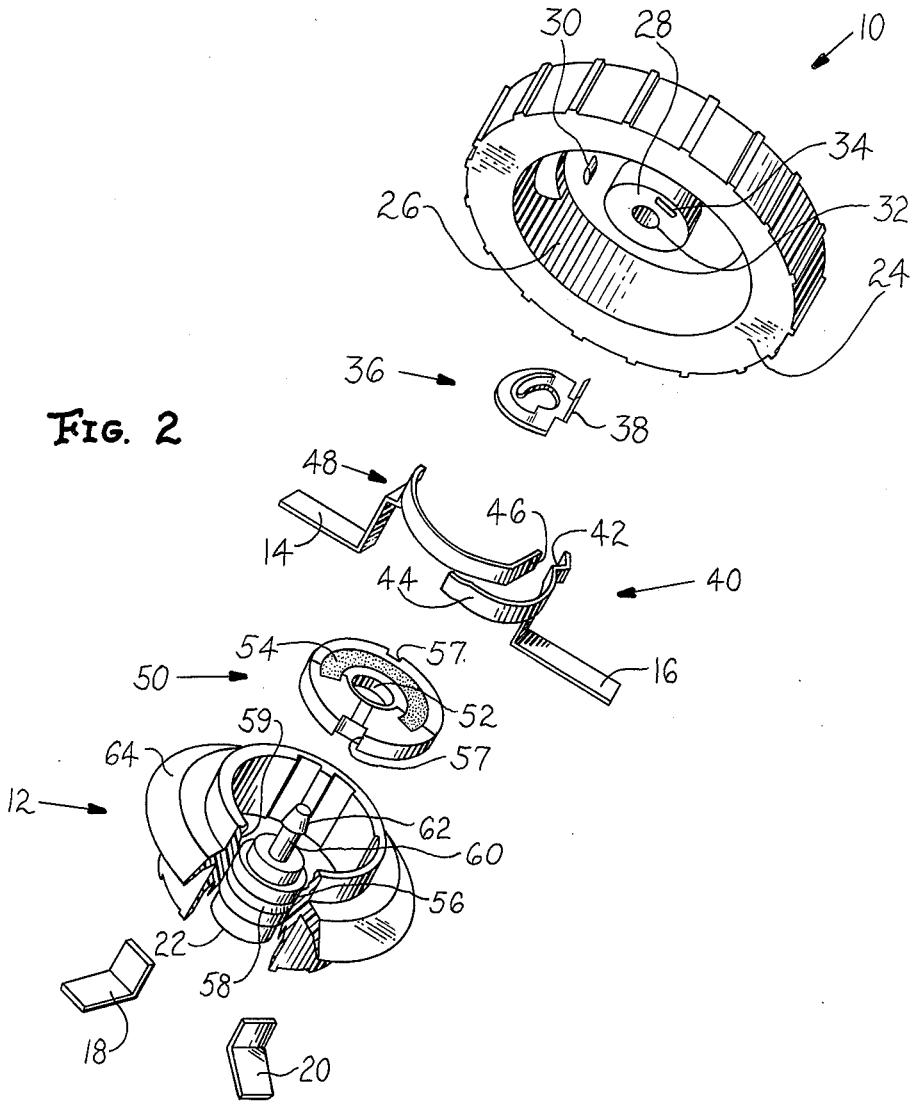
FIG. 2 is an exploded perspective view showing the components of the device shown in FIG. 1.
Figure 3:
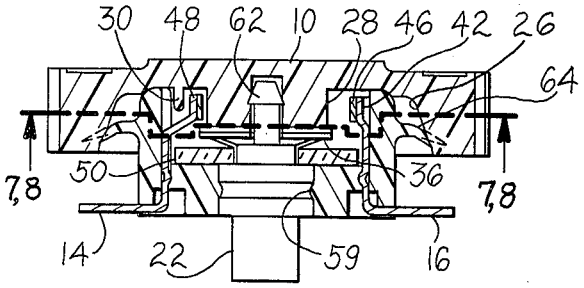
FIGS. 3 and 4 are sectional views taken respectively along lines 3—3 and 4—4 of FIG. 1.
Figure 4:
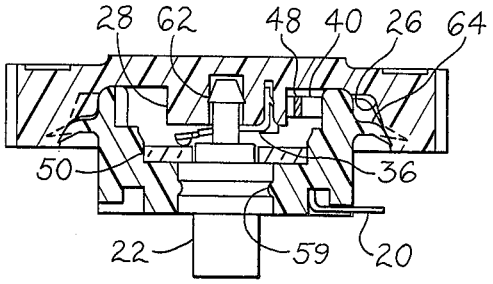

The internal construction of the device is shown in FIGS. 2, 3, and 4. Cap 10, the external shape of which should be convenient for manual operation, includes a central portion and an annular flange 24 which extends downwardly from the periphery of the central portion. The inner annular wall 26 of flange 24 is flared down and outwardly to assist in sealing the device, as described hereinafter. Extending down from the cap's central portion is a cylindrical boss 28, and an oval-shaped dowel 30 which functions as a switch blocking member. A recess 32, which is aligned with the cap's center axis, and also an off-centered slot 34 extend into the underside of the boss. A metallic contact or wiper spring 36 for electrically and mechanically bridging the potentiometer's resistance element and collector is provided with an upstanding tab 38 which fits into slot 34. A barb on tab 38 engages the boss material adjacent to the slot to firmly secure the spring in place.

The switch mechanism includes a flexible, resilient, metallic strip 40, one end of which forms a first switch contact area 42 and the other end of which is shaped as a detent 44 to give a positive snap feel when the switch is actuated. Terminal 16 depends from strip 40 and is formed integrally therewith. A second contact 46 is provided at the end of a metallic blade spring 48, from which terminal 14 depends. Strip 40 and blade 48 are cemented in place within corresponding slots in body portion 12.

A plastic or other nonconductive substrate 50, having a central aperture 52, fits into the interior of body portion 12. A resistance element 54 is formed from a suitable resistance material and deposited in an arc along the upper surface of substrate 50. The diameter of collector pin 22 is slightly less than that of substrate aperture 52, permitting the substrate to be slipped over the pin during assembly and rest on the upper surface of a ring 56 which girdles an intermediate portion of the pin. A pair of notches 57 in substrate 50 align with corresponding keys in the central body opening to correctly position the substrate. Pin 22 is in turn secured to body portion 12 by means of an annular recess 58 around ring 56, which recess receives a corresponding annular bead 59 formed around the central opening of body portion 12. The recess-bead combination also serves to seal the central opening of body portion 12. A post 60 formed integrally with pin 22 extends axially upward and has a downward and outward flaring chevron 62 at its upper end, the maximum diameter of which is slightly greater than the diameter of boss recess 32.

The housing is assembled by inserting molding pin 22 in the body portion opening so that bead 59 mates with recess 58, slipping substrate 50 over the upper end of pin 22 to rest on ring 56 and cementing it in place, positioning terminals 14, 16, 18 and 20, inserting wiper spring tab 38 into slot 34, and pressing body portion 12 and cap 10 together to insert chevron 62 into recess 32. The boss material is deformed by chevron 62 and prevents post 60 from slipping out of the recess, thereby holding the device securely together. Terminals 18 and 20 are electrically connected to resistance element 54 by means of a conductive epoxy or by soldering while a cement ring at the lower end of body portion 12 secures each of the terminals 14, 16, 18 and 20.

Body portion 12 is provided about its periphery with an annular shoulder in the form of a stiffly flexible, resilient lip 64. Nylon is preferred for lip 64, but other thermoplastic materials having suitable flexing and surface qualities could also be used. The upper surface of lip 64 (when unflexed) extends out from body portion 12 at an angle from horizontal which is less than that of inner cap flange wall 26. The unflexed position of lip 64 before cap 10 has been pressed into place is indicated, in somewhat exaggerated fashion, in dashed lines in FIGS. 3 and 4. Flange wall 26 abuts the upper surface of lip 64 when the component parts are brought together. With post 60 fully seated in recess 32, flange wall 26 presses against and flexes lip 64 downward so that the outer portion of the upper lip surface assumes the angle of wall 26 and is brought into a broad area contact therewith.

Alternatively, cap flange 24 could be provided in the form of a flexible lip which abuts an annular shoulder on body portion 12 such that the flange lip is flexed upward by the shoulder when the cap is pressed into place. In either case an effective rotary seal is created between the cap and body. An additional benefit is that, with a proper selection of materials, the area contact between the cap and body introduces a degree of friction which opposes rotation of the cap so as to give the user a positive, steady feel.

Figure 5:
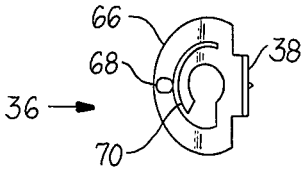
FIGS. 5 and 6 are respectively plan and elevation views of a wiper spring employed in the invention.
Figure 6:
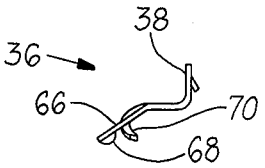

Details of wiper spring 36 are shown in FIGS. 5 and 6. In addition to tab 38, the spring includes a first downward inclined, arcuate strip 66 having a dimple 68 at its lower end for wiping resistance element 54, and a second downward inclined, arcuate strip 70 the end of which wipes the ring-shaped upper surface of collector pin 22 which surrounds the base of post 60. The wiping portions of spring 36 are flexed against their respective wiping surfaces when the device is assembled, thereby providing strong electrical and mechanical contacts.

Figure 7:
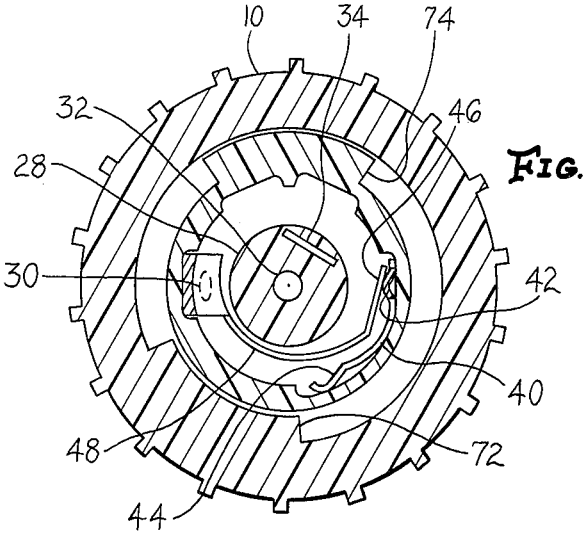
FIGS. 7 and 8 are bottom views of the cap and switch assembly taken along line 7,8—7,8 of FIG. 3, FIG. 7 showing the switch contacts closed and FIG. 8 showing the cap rotated to open the contacts.
Figure 8:
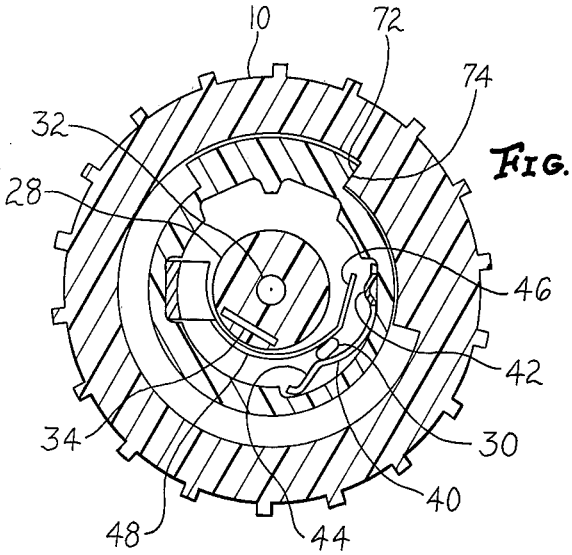

The switching mechanism is shown in detail in FIGS. 7 and 8, with post 60 and wiper spring 36 removed from cap 10 for clarity. Contact strip 40 is lodged in a recess in a side wall of the housing chamber, with contact area 42 and detent 44 bowed out from the wall. Blade spring 48 is lodged in another chamber wall recess with the blade extending cantilevered in an arc around the chamber to position contact area 46 adjacent to contact area 42. Blade 48 is flexed inwardly during assembly of the switch parts so that contact area 46 is urged against contact area 42. In the position shown in FIG. 7, cap 10 is at an operating position with dowel 30 rotated away from the contact region, allowing contact area 46 to flex outward and close against contact area 42. In FIG. 8 cap 10 has been rotated counterclockwise to a position at which dowel 30 has just passed the apex of detent 44 and is separating the two contact areas, holding the switch open. Further rotation is prevented by stops 72 and 74 on the cap and body portion respectively.

Detent 44 normally extends out from the chamber wall into the rotational path of dowel 30. The detent is flexed back toward the chamber wall and then released as dowel 30 is rotated into position between the contact areas, thus producing a positive snap feeling which indicates to the user that the switch has been actuated. This preferably occurs simultaneously with wiper spring 36 reaching the end of resistance element 54. A snap feel is again produced when the cap is rotated in a clockwise direction and dowel 30 causes detent 44 to flex and release as the contacts close. The recess for contact strip 40 is slightly greater in circumferential magnitude than the contact strip, allowing for expansion of the strip as detent 44 is flexed back against the chamber wall.

The described potentiometer/switch combination is quite simplified and economical. The environmental seal formed directly between the cap and body portion eliminates the need for separate sealing devices such as O-rings, while the cap is easily affixed to the body portion merely by pressing the two parts together to insert post 60 into boss recess 32. The large area of contact established in sealing the device also provides a smooth feel when the cap is rotated, which is further enhanced by the snap feel of detent 44 when the switch is actuated.

While a particular embodiment of the invention has been shown and described, numerous additional modifications and variations are possible in light of the above teachings. For example, it would be possible to connect the cap and body together by means of a chevron post extending from the cap into a recess in the body. It is therefore intended that the scope of the invention be limited only in and by the terms of the appended claims.

What is claimed is:

1. A rotary potentiometer, comprising:

a body portion having an annular shoulder around its periphery, a resistance element and collector means secured to said body portion, termination means associated with said resistance element and collector means, a control cap rotatably positioned over said body portion and forming therewith a housing for said resistance element and collector means, said cap having an annular flange abutting said body portion shoulder, means securing said cap to said body portion, and electrically conductive wiper means controlled by rotation of said cap for electrically and mechanically coupling said resistance element to said collector means, switch means including first and second contact means situate in said control cap, dowel means for separating said first and second contact means in response to rotation of said control cap, at least one of said body portion shoulder and cap flange being formed from a stiffly flexible, resilient material, said securing means holding said cap and body portion together with sufficient pressure to deform said stiffly flexible, resilient material and provide a frictional seal between said body shoulder and cap flange, thereby sealing the interior of said housing and introducing a counter torque to rotation of said cap.

2. The potentiometer of claim 1, wherein said body shoulder comprises a stiffly flexible, resilient lip having an upper surface extending outwardly from said body portion at a first, unflexed angle from horizontal, and said annular flange includes an annular inner wall disposed at a second angle to horizontal which is greater than said first angle, said cap being press-fit over said body portion to flex said lip downwardly and establish an annular frictional surface contact between said inner flange wall and said upper lip surface.

3. The potentiometer of claim 2, wherein said lip is formed from nylon.

4. The potentiometer of claim 1, wherein said means securing the cap to the body portion comprises the combination of a boss formed from a stiffly flexible, resilient material and extending downwardly from the underside of said cap, an axial recess extending into said boss from its underside, a post extending axially upward from a base at said body portion, and a downward and outward flaring chevron on said post, said chevron being of slightly greater diameter at its lower edge than the diameter of said recess and lodged in said recess with its lower edge deforming the adjacent boss material to prevent said body portion and cap from separating.

5. The potentiometer of claim 4, wherein said collector means comprises an electrically conductive ring formed integrally with and surrounding the base of said post, and said wiper means comprises an electrically conductive spring means secured to said cap and extending downwardly therefrom to wipe against said resistance element and said ring.

6. The potentiometer of claim 5, said boss having a slot extending thereinto from its underside and offset from said recess, and said wiper spring including a tab extending into said slot with a barb thereon engaging the boss material to secure said wiper spring to said boss.

7. The potentiometer of claim 1, said housing forming an interior chamber, said resistance element and collector means being held in said chamber, and further including a switch means comprising a first switch contact means held in said chamber proximate to a side wall thereof, a second switch contact means, terminals associated with each of said switch contact means, cantilever spring means holding said second contact means adjacent to and radially inward from said first contact means, said spring means urging said second contact means towards said first contact means, and a nonconductive blocking member projecting downwardly from said cap between said first and second contact means, said blocking member being moved out from between said two contact means by rotation of said cap to enable closing of said contact means, and thereafter returning to a position separating said contact means by counter-rotation of said cap.

8. The potentiometer of claim 7, and further including a spring detent formed on said first switch contact means in the rotational path of said blocking member and positioned to be flexed by said blocking member substantially concurrently with switching of said two contact means to produce a positive switch feel.

9. The potentiometer of claim 7, wherein said means securing the cap to the body portion comprises the combination of a boss formed from a stiffly flexible, resilient material and extending downwardly from the underside of said cap, an axial recess extending into said boss from its underside, a post extending axially upward from said body portion, and a downward and outward flaring chevron on said post, said chevron being of slightly greater diameter at its lower edge than the diameter of said recess and lodged in said recess with its lower edge deforming the adjacent boss material to prevent said body portion and cap from separating.

10. In a rotary potentiometer having a housing forming an interior cavity, a resistance element and collector means held in said chamber, a control cap rotatably secured over said chamber, termination means associated with said resistance element and collector means, and means controlled by rotation of said cap for electrically and mechanically coupling said resistance element to said collector means, the improvement comprising a switch means which comprises:

a first switch contact means held in said chamber and spaced from the center thereof, a second switch contact means, terminals associated with each of said switch contact means, cantilever spring means holding said second contact means adjacent to and radially inward from said first contact means, said spring means urging said second contact means towards said first contact means, and a nonconductive blocking member projecting downwardly from said cap between said first and second contact means, said blocking member being moved out from between said two contact means by rotation of said cap to enable closing of said contact means, and thereafter returning to a position separating said contact means by counter-rotation of said cap.

11. The potentiometer of claim 10, said cantilever spring means comprising a flexible, resilient, conductive blade secured to said body portion at one end and extending in a flexed arc around a portion of said chamber, said second switch contact means being integrally formed on said blade at the other end thereof.

12. The potentiometer of claim 10, and further including a spring detent formed on said first switch contact means in the rotational path of said blocking member and positioned to be flexed by said blocking member when said contact means are switched, thereby producing a positive switch feel.

13. The potentiometer of claim 12, said first contact means and spring detent being formed by a single flexible, resilient, conductive strip held adjacent to a side wall of said cavity, the detent portion of said strip being spaced from said cavity wall.

14. The potentiometer of claim 10, said cap being secured to said body portion by means comprising the combination of a boss formed from a stiffly flexible, resilient material and extending downwardly from the underside of said cap, an axial recess extending into said boss from its underside, a post extending axially upward from said body portion, and a downward and outward flaring chevron on said post, said chevron being of slightly greater diameter at its lower edge than the diameter of said recess and lodged in said recess with its lower edge deforming the adjacent boss material to prevent said body portion and cap from separating.

15. In a rotary potentiometer having a body portion, a resistance element and collector means secured to said body portion, termination means associated with said resistance element and collector means, a rotatable control cap positioned over said body portion, and means controlled by rotation of said cap for electrically and mechanically coupling said resistance element to said collector means, the improvement comprising:

means for securing said cap to said body portion, said means comprising the combination of a boss formed from a stiffly flexible, resilient material and extending downwardly from the underside of said cap, an axial recess extending into said boss from its underside, a post extending axially upward from a base on said body portion, and a downward and outward flaring chevron on said post, said chevron being of slightly greater diameter at its lower edge than the diameter of said recess and lodged in said recess with its lower edge deforming the adjacent boss material to prevent said body portion and cap from separating.

16. The potentiometer of claim 15, wherein said collector means comprises an electrically conductive ring formed integrally with and surrounding the base of said post, and said wiper means comprises an electrically conductive spring means secured to said cap and extending downwardly therefrom to wipe against said resistance element and said ring.

17. The potentiometer of claim 16, said collector ring comprising a surface of a collector pin formed in a unitary construction with said post.

18. The potentiometer of claim 16, said boss having a slot extending thereinto from its underside and offset from said recess, and said wiper spring including a tab extending into said slot with a barb thereon engaging the boss material to secure said wiper spring to said boss.

* * * * *